US005297608A

United States Patent [19]

Rap et al.

[11] Patent Number: 5,297,608

[45] Date of Patent: Mar. 29, 1994

[54] TILTER MECHANISM

[75] Inventors: William H. Rap, Buena Park, Calif.; Ira Gaber, West Norwalk, Conn.; Cooper C. Woodring, Topeka, Kans.

[73] Assignee: Nien Made Enterprise Co., Ltd., Chang Hua, Taiwan

[21] Appl. No.: 986,012

[22] Filed: Dec. 4, 1992

[51] Int. Cl.[5] ..... E06B 9/38

[52] U.S. Cl. ..... 160/177

[58] Field of Search ..... 160/177, 176.1, 174, 160/168.1, 170, 171, 172, 173, 166.1

[56] References Cited

U.S. PATENT DOCUMENTS

| | | | |
|---|---|---|---|
| 2,209,234 | 7/1940 | Nardulli | 160/176.1 X |
| 2,265,651 | 12/1941 | Mackin | 160/176.1 X |
| 2,544,184 | 3/1951 | Rosenbaum | 160/177 |
| 2,555,709 | 6/1951 | Sherwood | 160/168.1 |
| 2,620,866 | 12/1952 | Rosenbaum | 160/177 |
| 3,552,473 | 1/1971 | Persson | 160/176.1 X |
| 3,605,852 | 9/1971 | Vecchiarelli | 160/176.1 X |
| 4,168,735 | 9/1979 | Frei | 160/176.1 |

*Primary Examiner*—David M. Purol

*Attorney, Agent, or Firm*—Bacon & Thomas

[57] ABSTRACT

A tilter mechanism for rotating a headrail so as to tilt slats of a Venetian blind includes a fixed hollow drum secured to the headrail; a hollow rotary mechanism rotatably fixed in the hollow drum, including a pulley section and an fixing section engaged with the headrail for synchronous motion; and a tilt cord made of soft material wound around the pulley section such that pulling of the tilt cord results in the rotary mechanism and the headrail being rotated synchronously and the slats being tilted.

6 Claims, 6 Drawing Sheets

TILTER MECHANISM

BACKGROUND OF THE INVENTION (1) Field of the Invention

The present invention relates to a tilter for a Venetian blind, particularly a tilter mechanism to directly rotate a headrail of the Venetian blind.

(2) Description of the Prior Art

Venetian blinds are composed of a plurality of vertical or horizontal slats running in parallel, tilting of which can adjust indoor darkness and preserve privacy. They are. It is being extensively used in offices and homes. The conventional horizontal Venetian blind being used can have its slats tilted and lifted, and comprises mainly a rectangular sectioned and non-rotary headrail, a foot rail, two or more ladders each including an outer ladder and an inner ladder suspend from the headrail to the foot rail to support a plurality of slats with a plurality of connecting tapes located between the outer and inner ladders, and a tilter within the headrail and a transmission device therefor to tilt the slats. The tilter and the transmission device are incorporated with a handle to tilt the slats manually, and are substantially in a form of the drum driven by a worm drive through the handle for rotation, include at least two tilt drums each wound by a ladder to support the ladder, and a transmission shaft located between the tilt drums to rotate the tilt drums simultaneously. When the handle is operated, the ladders are moved linearly by the tilter, transmission shaft and the tilt drums, the outer and inner ladders are moved in two opposite directions to tilt the slats between them.

The conventional tilter for Venetian blind is firmly secured to a headrail, and has a worm drive and a plurality of transmission shafts to rotate the respective ladder drums suspending the slats. Such a tilter has a quite complicated structure, and hence, its production cost is high. Moreover, it is hard to implement mass production with an automatic assembly process, and it has the following defects:

(1) In general a ladder drum is located near each end of the headrail to maintain a good balance for the slats, but a transmission shaft having a length nearly equal to the length of the headrail must be provided between the ladder drums, and a plurality of bearings must be placed to support such a long transmission shaft, hence, the overall weight of the Venetian blind is significantly increased, the long transmission shaft means a relatively long momentum arm, and a considerable large force is required to rotate the ladder drums simultaneously for tilting the slats to a desired angle.

(2) Such sophisticated tilter requires assembly at a factory, and its installation position can not be changed after it is assembled to satisfy the user's personal taste or environmental requirements. Production and use of such tilters are inconvenient.

(3) The worm drive, bearing and gears in the conventional tilter will lose its transmission efficiency due to improper use, prolonged exposure to dusts and other factors which damage proper engagement among its components.

SUMMARY OF THE INVENTION

The present invention provides a revolutionary design concept for a tilter of a Venetian blind to overcome the above defects. The tilter according to the present invention can drive the headrail of the blind to rotate it directly, and consequently the ladder holders fixed the headrail to rotate simultaneously without the use of a worm drive, gears, a long transmission shaft and bearings as are needed in the conventional tilter. The tilter mechanism according to the present invention comprises a hollow drum secured to a window frame a door frame, an end cover, and a rotary mechanism extending out of the drum and connected to the tubular headrail so that pulling of a tilt cord can drive the rotary mechanism to rotate which consequently rotates the tubular headrail simultaneously so as to tilt the slats suspending from the tubular headrail to any desired angle.

Therefore, the main object of the present invention is to provide a tilter mechanism for a Venetian blind with minimum components and simple structure. It is a design that permits mass production with an automatic assembly process at low production cost.

Another, object ,of the present invention is to provide a tilter mechanism for a Venetian blind which permits efficient and prompt adjustment of slat tilting, assures easy operation, permits long service life and provides minimum failure possibility in comparison with the conventional tilter.

Another object of the present invention is to provide a tilter mechanism which can be installed at either end of the headrail to satisfy different user's personal taste and different indoor installation requirements.

Another object of the present invention is to provide a tilter mechanism for a Venetian blind to be supplied to the general consumers in the form of a "DIY" kit to permit assembly and replacement of slats by the consumers.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
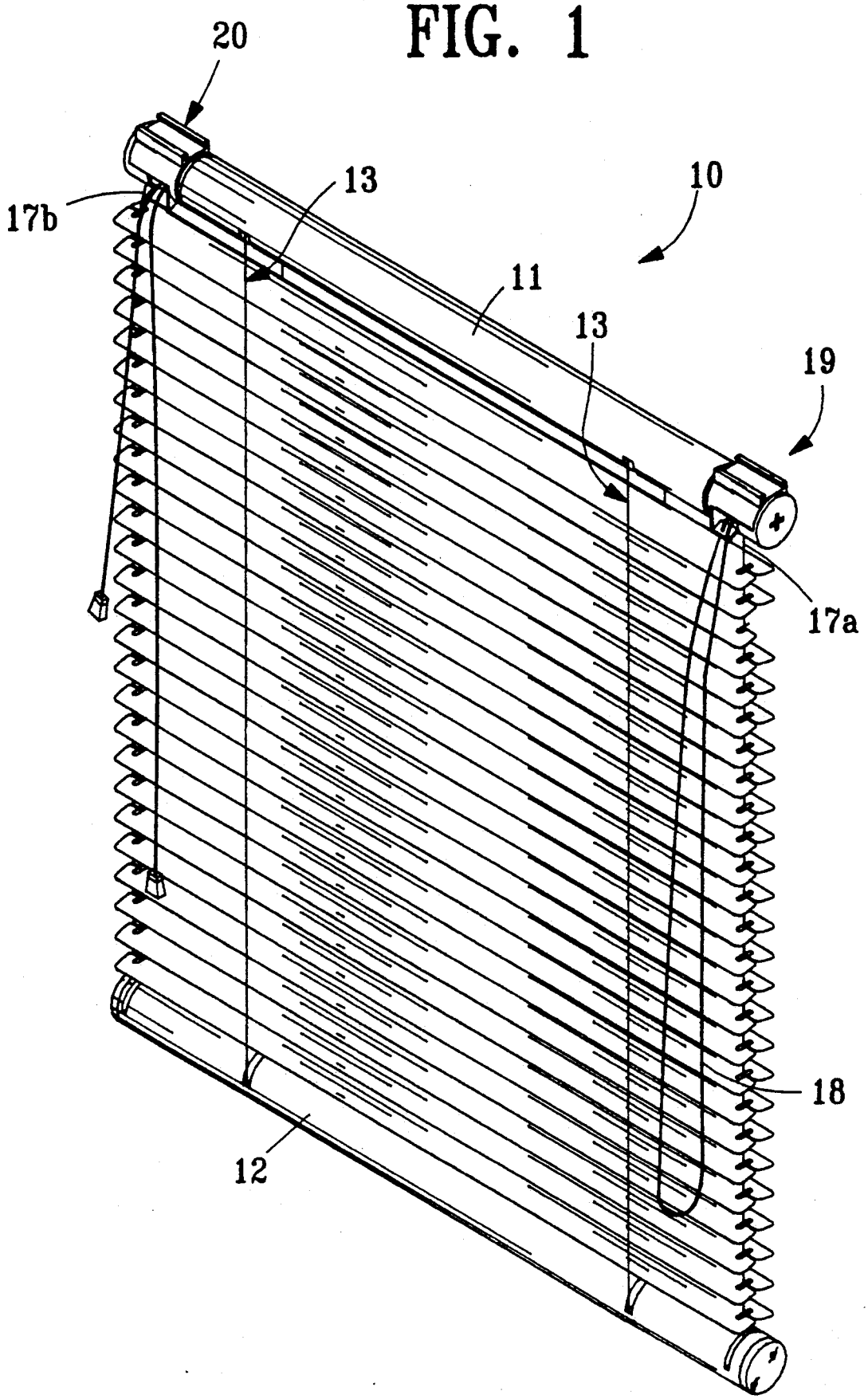
FIG. 1 a perspective view of a horizontal Venetian with a tilter mechanism according to the present invention.
Figure 2:
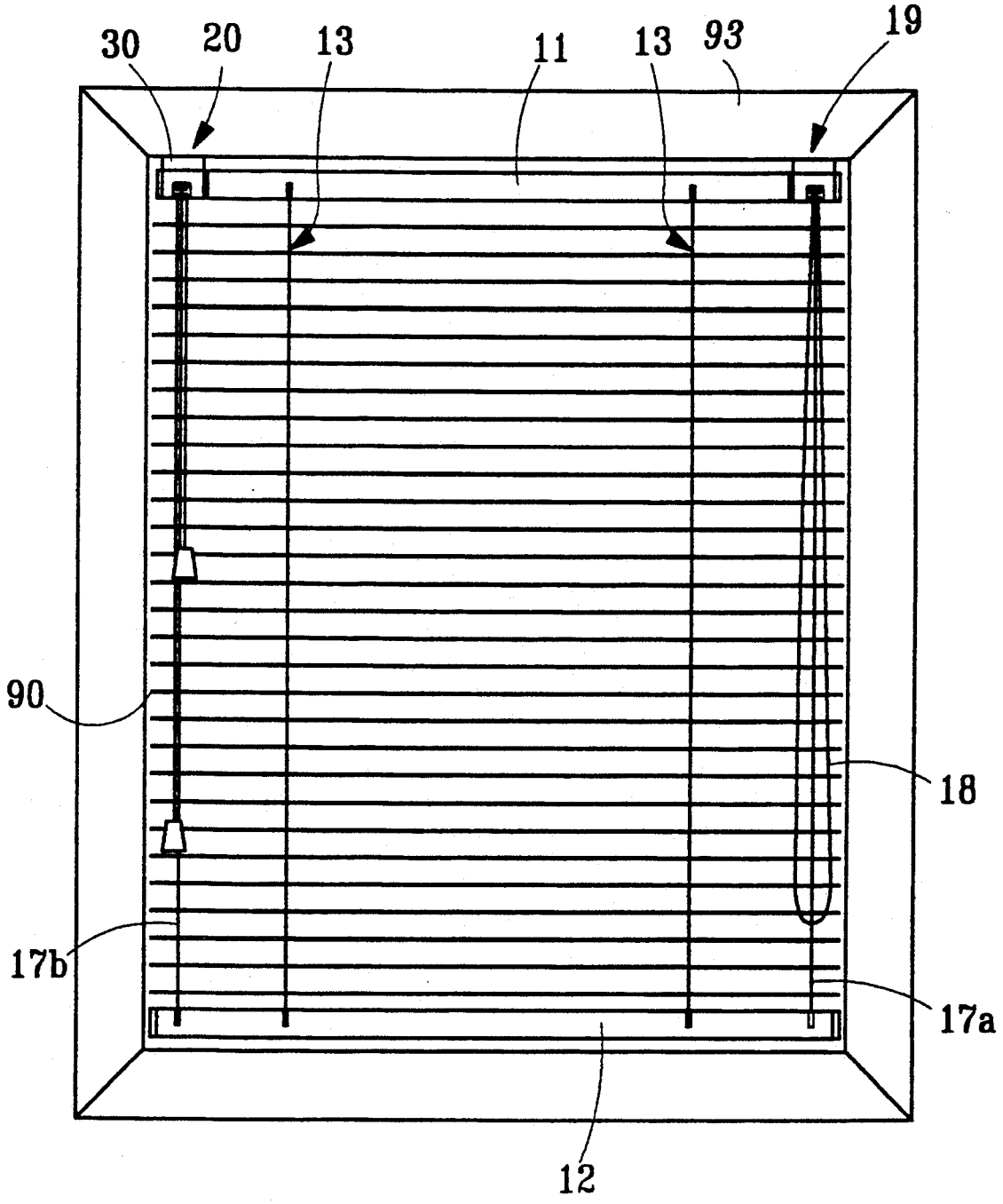
FIG. 2 is a front view of the Venetian blind as installed in a window frame.
Figure 3:
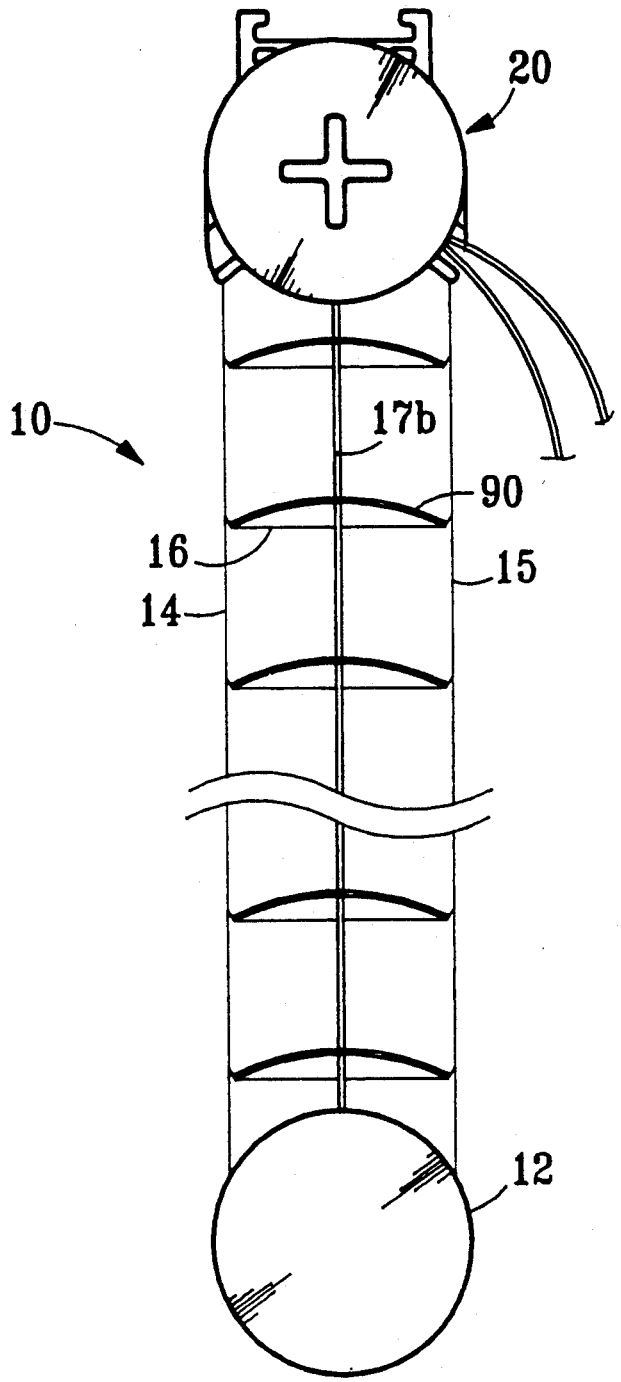
FIG. 3 is a magnified side view of the Venetian blind.
Figure 4:
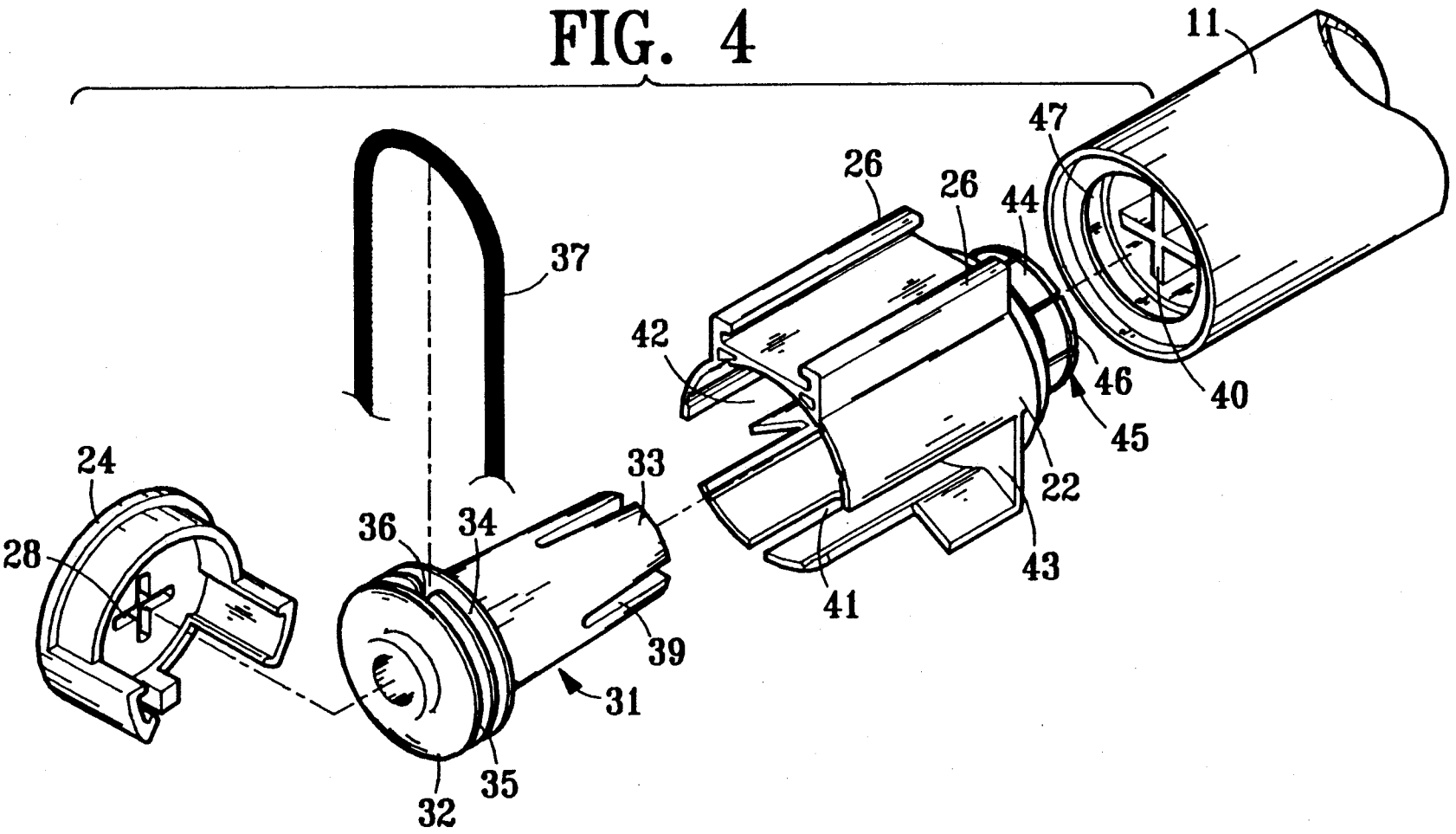
FIG. 4 is a perspective fragmented view of the tilter mechanism according to the present invention.

Referring to FIGS. 1 through 3, the Venetian blind (10) incorporated with the tilter mechanism (20) according to the present invention comprises mainly a rotary tubular headrail (11), a rotary tubular foot rail (12), two ladder sets (13) extending from the headrail (11) to the foot rail (12) to support a plurality of parallel horizontal slats (90), a tilter (20) located at an end of the headrail (11), and a lifter (19) located at another end of the headrail (11). Each ladder set (13) is composed of an outer ladder tape (14), an inner ladder tape (15), a plurality of horizontal connecting tapes (16) each beneath a slat (90) to support a slat (90), and two pull cords (17*a* and 17*b*) extending from the headrail (11) to the foot rail (12) and substantially connected to a lift cord (18) for lifting and lowering of the slats (90) outside the blind (10). When the lift cord (18) is pulled downward manually, the pull cords (17*a* and 17*b*) are raised synchronously to lift the foot rail (12) so that the slats (90) are displaced upward and overlaid in sequence to close the blind (10). The ladder sets (13) are placed between an end of the headrail (11) and an end of the foot rail (12) at the same side directly, and retained between the headrail (11) and the foot rail (12) with a ladder holder (not shown) indirectly. When the headrail (11) is rotated, the ladder tapes (14 and 15) at opposite sides of the headrail each to perform vertical movement linearly in opposite directions so that the slats supported by the horizontal connecting tape (16) are tilted to the same degree accordingly.

Figure 6:
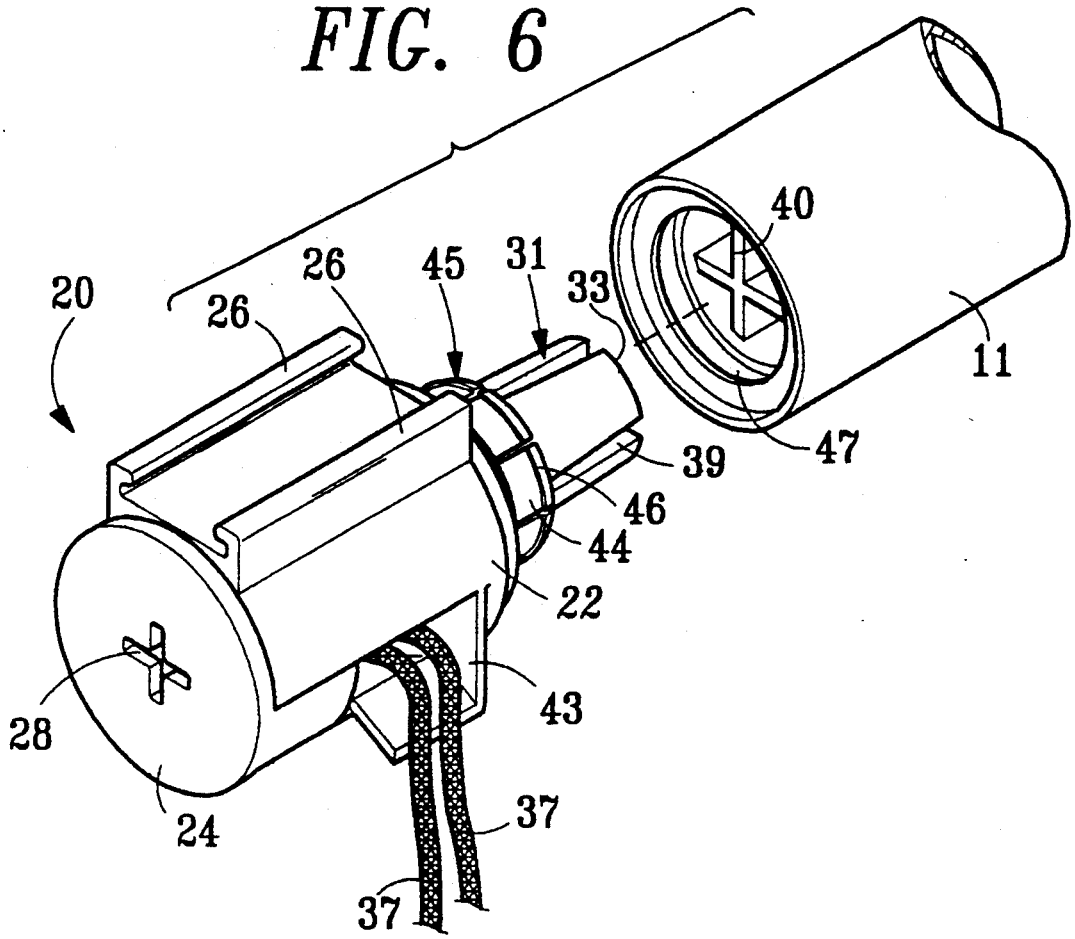
FIG. 6 is a perspective view of the tilter mechanism according to the present invention.
Figure 5:
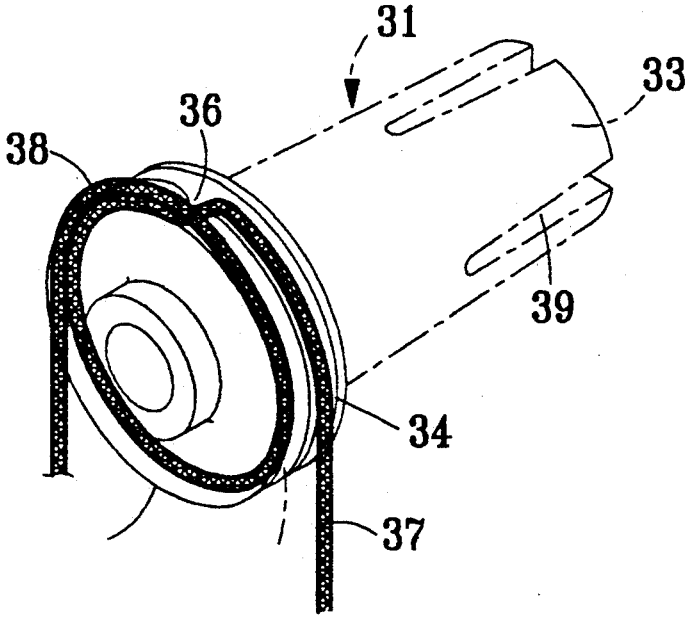
FIG. 5 is a perspective view illustrating a tilt cord wound around a rotary mechanism in the tilter mechanism, in which the rotary mechanism is shown with dashed lines.
Figure 8:
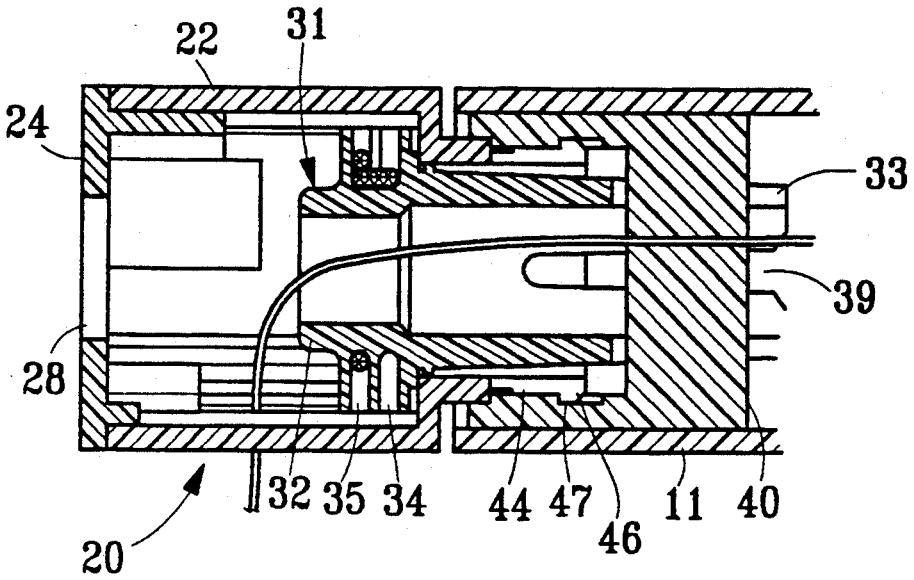
FIG. 8 is a sectional view taken along line 8—8 in FIG. 7.

Referring to FIGS. 4 thru 8, the tilter (20) which rotates the headrail (11) directly to tilt the slats (90) comprises mainly a hollow drum (22) secured to a window frame (93). An end cover (24) to closes the hollow drum (22). The hollow drum (22) has a pair of upward extended ribs (26), and the end cover (24) has a cross slot (28). The drums (22) can be easily secured to a side of the window frame (93) with the extended ribs (26) or the cross slot, (28) by means of any conventional fasteners. The tilter (20) includes further a rotary member (31). The rotary member (31) is a hollow structure with an extended fixing section (33) and a pulley section (32). The pulley section (32) has two cord ways (34 and 35) formed by three rims. A notch (36) is formed at the middle rim so as to connect the cord ways (34 and 35). As shown in FIG. 5, a tilt cord (37) made of soft material is wound from a cord way (34) to the other cord way (35) through the notch (36). The tilt cord (37) winding on the cord way (34) has an overlapped portion (38). Because of friction between the tilt cord (37) and the surface of the cord ways (34 and 35), pulling of the tilt cord (37) can rotate the rotary member. The extended fixing section (33) has four notches (39) arranged annularly in equal distance. As shown in FIGS. 6 and 8, the extended fixing section (33) can be partly extended from the drum (22) into the tubular headrail (11), and its four notches (39) are engaged with a cross driven element (40) in the tubular headrail (11) when the rotary member (31) is installed into the drums (22). Therefore, when the rotary member (31) is rotated, the tubular headrail (11) is driven to rotate simultaneously.

Figure 7:
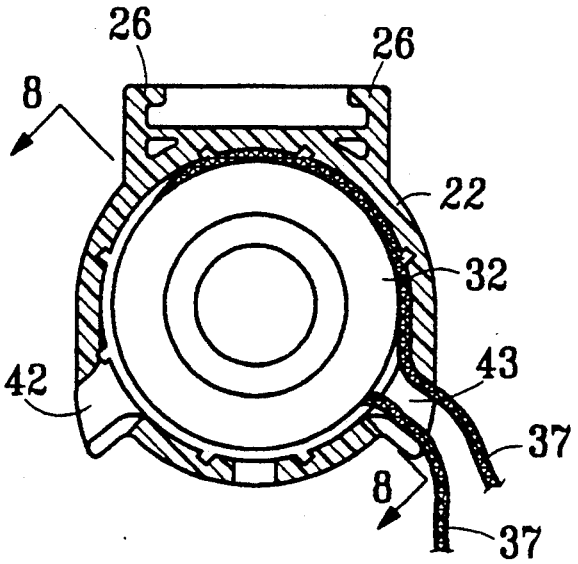
FIG. 7 is a longitudinal sectional view of the tilter mechanism according to the present invention.

The drum (22) can be secured to either end of the headrail (11), and hence it is designed with a cord outlet (41) in the middle of its bottom side, and two symmetric cord outlets (42 and 43), one at the left side and the other at the right side. As shown in FIGS. 6 and 7, both ends of the tilt cord (37) are extended out of the drum (22) through either the cord outlet (42) or another cord outlet (43) so that an end of the tilt cord (37) can be pulled indoors and consequently the rotary member (31) and the tubular headrail (11) can be driven to rotate clockwise or counterclockwise, and then the ladder sets (13) can be driven to pull the slats (90) to rotate to the desired angle.

The drum (22) has a connecting section (45) composed of a plurality of elastic connecting elements (44) arranged annularly in equal distance near an end of the tubular headrail (11). Each elastic connecting element (44) has a wedged end (46) extending outward. When the connecting section (45) of the drum (22) is fixed in the tubular headrail (11), the wedged ends (46) of the respective elastic connecting elements (44) are retained in a retaining groove (47) in the tubular headrail (11) so that the drum (22) is rotatably connected to the tubular headrail (11) without risk of disengagement.

In comparison with the conventional tilter, the tilter mechanism according to the present invention has the following advantages:

(1) It directly rotates the headrail and consequently causes the ladder tapes at both side of the ladder to perform vertical movement linearly in opposite directions in order to tilt the slats. In comparison with the conventional tilter which has a fixed headrail and uses a handle to drive a worm drive, a transmission shaft and a gear train to rotate the ladder drums for opposite linear movement of the ladder tapes, the present invention has less components and a simple structure which permits mass production with automatic assembly process at low production cost.

(2) A tilt cord is used to tilt the slats, which means high efficiency in comparison with the conventional operating handle. Since no transmission shaft is used, the slats can be tilted promptly with less effort. It is easy to operate, durable and requires less service in comparison with the conventional tilter.

(3) The tilter can be installed at either end of the headrail to satisfy different user's personal taste and different indoor installation requirements.

(4) It can be supplied to general consumers in the form of a "DIY" kit to permit assembly and replacement of the tilter by the consumers.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A tilter mechanism for use with a Venetian blind having a rotary tubular headrail, a rotary tubular foot rail, at least two ladder sets fixed between the headrail and the foot rail with each ladder set having an inner ladder tape and an outer ladder tape running in parallel with each other as well as a plurality of equidistant and parallel horizontal connecting tapes each supporting a slat between the inner and outer ladder tapes above respective horizontal connecting tapes, said tilter mechanism comprising:

a hollow drum secured to the head rail, said drum having a middle cord outlet and a side cord outlet;

an end cover secured to said drum;

a hollow rotary mechanism rotatably mounted in said drum, said rotary mechanism including a pulley section having two cord ways defined by three spaced rims with a notch formed in a central one of said rims for interconnecting the two cord ways and a connector which extends out of said drum and engages with the headrail for synchronous motion therewith;

a tilt cord, made of soft material, wound around the pulley section and having an end extending out of said side cord outlet, whereby pulling of the tilt cord results in the rotary mechanism and the headrail being rotated synchronously with the inner ladder type and the outer ladder tape being linearly driven by the rotating headrail to move vertically in opposite direction so that the slats are tilted with the same degree of rotation.

2. The tilter mechanism as claimed in claim 1, wherein the tilt cord is wound from one of the two cord ways to the other of the two cord ways through said notch with the tilt cord winding between the two cord ways having an overlapped portion.

3. The tilter mechanism as claimed in claim 1, wherein said drum includes two side cord outlets symmetrically located on two opposite sides thereof.

4. A tilter mechanism for use with a venetian blind having a rotary tubular headrail, a rotary tubular foot rail, at least two ladder satisfied between the headrail and the foot rail with each ladder set having an inner ladder tape and an outer ladder tape running in parallel with each other as well as a plurality of equidistant and parallel horizontal connecting tapes each supporting a slat between the inner and outer ladder tapes above respective horizontal connecting tapes, said tilter mechanism comprising:

a hollow drum secured to the head rail, said drum having a middle cord outlet and a side cord outlet;

an end cover secured to said drum;

a hollow rotary mechanism rotatably mounted in said drum, said rotary mechanism including a pulley section and a connector having a plurality of notches arranged annularly in equal distance, wherein said connector can partially extend from said drum into the tubular headrail so that the plurality of notches engage a polygonal driven element in the tubular headrail for synchronous motion;

a tilt cord, made of soft material, wound around the pulley section and having an end extending out of side cord outlet, whereby pulling of the tilt cord results in the rotary mechanism and the headrail being rotated synchronously with the inner ladder tape and the outer ladder tape being linearly driven by the rotating headrail to move vertically in opposite directions so that the slats are tilted with the same degree of rotation.

5. A tilter mechanism as claimed in claim 4, wherein said connector is provided with four, annularly spaced notches.

6. A tilter mechanism for use with a venetian blind having a rotary tubular headrail, a rotary tubular foot rail, at least two ladder sets fixed between the headrail and the foot rail with each ladder set having an inner ladder tape and an outer ladder tape running in parallel with each other as well as a plurality of equidistant and parallel horizontal connecting tapes each supporting a slat between the inner and outer ladder tapes above respective horizontal connecting tapes, said tilter mechanism comprising:

a hollow drum having a middle cord outlet, a side cord outlet and a connecting section composed of a plurality of elastic connecting elements arranged annularly, the headrail having a connecting slot corresponding to said connecting section so that said drum can be rotatably engaged with the headrail;

an end cover secured to said drum;

a hollow rotary mechanism rotatably mounted in said drum, said rotary mechanism including a pulley section and a connector which extends out of drum and engages with the headrail for synchronous motion therewith;

a tilt cord, made of soft material, wound around the pulley section and having an end extending out of said side cord outlet, whereby pulling of the tilt cord results in the rotary mechanism and the headrail being rotated synchronously with the inner ladder tape and the outer ladder tape being linearly driven by the rotating headrail to move vertically in opposite directions so that the slats are tilted with the same degree of rotation.

* * * * *